US009384918B2

(12) United States Patent
Chen

(10) Patent No.: US 9,384,918 B2
(45) Date of Patent: Jul. 5, 2016

(54) ILLUMINATED KEYBOARD

(71) Applicant: Primax Electronics Ltd., Taipei (TW)

(72) Inventor: Chung-Yuan Chen, Taipei (TW)

(73) Assignee: PRIMAX ELECTRONICS LTD., Neihu, Taipei (TW)

( * ) Notice: Subject to any disclaimer, the term of this patent is extended or adjusted under 35 U.S.C. 154(b) by 0 days.

(21) Appl. No.: 13/760,779

(22) Filed: Feb. 6, 2013

(65) Prior Publication Data

US 2014/0138226 A1 May 22, 2014

(30) Foreign Application Priority Data

Nov. 21, 2012 (TW) ..... 101143407 A

(51) Int. Cl.
*H01H 9/00* (2006.01)
*H01H 13/705* (2006.01)

(52) U.S. Cl.
CPC ..... *H01H 13/705* (2013.01)

(58) Field of Classification Search
CPC ..... H01H 13/705; G02B 6/0083
USPC ..... 200/310, 314
See application file for complete search history.

(56) References Cited

U.S. PATENT DOCUMENTS

| | | | | |
|---|---|---|---|---|
| 5,397,867 | A * | 3/1995 | Demeo | 200/5 A |
| 7,503,683 | B2 * | 3/2009 | Liu | 362/616 |
| 7,628,500 | B2 * | 12/2009 | Chou | 362/30 |
| 7,781,688 | B2 * | 8/2010 | Regen et al. | 200/314 |
| 8,173,922 | B2 * | 5/2012 | Chen | 200/314 |

* cited by examiner

*Primary Examiner* — Kyung Lee
(74) *Attorney, Agent, or Firm* — WPAT, PC; Justin King

(57) ABSTRACT

An illuminated keyboard includes a key structure and a backlight membrane switch board. The backlight membrane switch board includes a light source, a light guide plate, a wiring plate, and a partition plate. The light guide plate includes a first circuit layer. The wiring plate includes a second circuit layer and a light source circuit layer. The electrical connection between the first circuit layer and the second circuit layer results in a key signal. The light source circuit layer is used for driving the light source. Since the first circuit layer is disposed on the light guide plate, less amount of substrates is required and the illuminated keyboard is slim. Moreover, since the second circuit layer and the light source circuit layer have a shared pin, the ease of assembling the backlight membrane switch board is enhanced.

16 Claims, 4 Drawing Sheets

ILLUMINATED KEYBOARD

FIELD OF THE INVENTION

The present invention relates to a keyboard, and more particularly to an illuminated keyboard.

BACKGROUND OF THE INVENTION

For allowing users to operate keyboards in a dark or dim environment, some keyboards with light sources such as light emitting diodes (LED) have been introduced into the market. The light sources may provide light beams to illuminate the keyboards. The keyboards with the illuminating functions are also referred as illuminated keyboards. By using the illuminated keyboards, the users can easily identify the characters or the symbols marked on the keys of the illuminated keyboards.

FIG. 1 is a schematic cross-sectional view illustrating a conventional illuminated keyboard. As shown in FIG. 1, the conventional illuminated keyboard 10 comprises plural key structures 11, a membrane switch board 12, a backlight module 13, and a base plate 14. For clarification and brevity, only one key structure 11 is shown in FIG. 1. The membrane switch board 12 comprises an upper wiring plate 15, a lower wiring plate 16, and a partition plate 17. The backlight module 13 comprises a light guide plate 18, a flexible circuit board 19, and a light source L.

The key structure 11 is disposed over the membrane switch board 12 to be depressed by the user. When the key structure 11 is depressed, the membrane switch board 12 is electrically conducted to generate a key signal. The detailed structure of the membrane switch board 12 will be illustrated as follows.

In the membrane switch board 12, the upper wiring plate 15 comprises an upper circuit layer 151, and the lower wiring plate 16 comprises a lower circuit layer 161. The upper circuit layer 151 and the lower circuit layer 161 are circuit patterns, which are made of electrically-conductive material. The upper wiring plate 15 is disposed over the lower wiring plate 16. The partition plate 17 comprises plural perforations 171. Moreover, the partition plate 17 is arranged between the upper wiring plate 15 and the lower wiring plate 16 for preventing erroneous contact between the upper wiring plate 15 and the lower wiring plate 16.

As the key structure 11 is depressed, the upper wiring plate 15 is subjected to deformation. Consequently, the upper circuit layer 151 of the upper wiring plate 15 is penetrated through the corresponding perforation 171 of the partition plate 17, and the upper circuit layer 151 of the upper wiring plate 15 is contacted with the lower circuit layer 161 of the lower wiring plate 16. Under this circumstance, the electrical connection between the upper circuit layer 151 and the lower circuit layer 161 results in the key signal.

The backlight module 13 is disposed under the membrane switch board 12 for illuminating the key structure 11. The backlight module 13 comprises the light guide plate 18, the flexible circuit board 19, and the light source L. The light source L is disposed on the flexible circuit board 19. Moreover, the flexible circuit board 19 comprises a light source circuit layer (not shown) for driving the light source L. The light guide plate 18 is located at a side of the light source L for transferring the light beam which is emitted by the light source L. The base plate 14 is disposed under the backlight module 13 for supporting the key structure 11, the membrane switch board 12 and the backlight module 13.

By means of the light source L and the light guide plate 18, the light beam from the light source L can be uniformly transferred to each key structure 11. Consequently, the illuminated keyboard 10 has the backlighting function, and the number of the light sources L is reduced. Under this circumstance, the illuminated keyboard 10 is power-saving and cost-effective.

However, the conventional illuminated keyboard 10 still has some drawbacks. For example, since the light source L and the light guide plate 18 have inherent thickness, the arrangement of the light source L and the light guide plate 18 under the membrane switch board 12 may increase the overall height of the illuminated keyboard 10. As known, it is difficult to further reduce the thickness of the illuminated keyboard 10.

Therefore, there is a need of providing an improved illuminated keyboard in order to eliminate the above drawbacks.

SUMMARY OF THE INVENTION

The present invention provides an illuminated keyboard with a reduced overall thickness.

In accordance with an aspect of the present invention, there is provided an illuminated keyboard. The illuminated keyboard includes a key structure and a backlight membrane switch board. When the key structure is depressed, a key signal is correspondingly triggered. The backlight membrane switch board is used for generating the key signal and emitting a light beam to the key structure. The backlight membrane switch board includes a light source, a light guide plate, a wiring plate, and a partition plate. The light source is used for emitting the light beam. The light guide plate is used for transferring the light beam. The light guide plate includes a first circuit layer. The wiring plate includes a second circuit layer and a light source circuit layer. The light source circuit layer is electrically connected with the light source for driving the light source. The partition plate is arranged between the light guide plate and the wiring plate. As the key structure is depressed, the first circuit layer of the light guide plate and the second circuit layer of the wiring plate are contacted with each other to generate the key signal.

In an embodiment, the light guide plate, the wiring plate and the partition plate are made of light-transmissible material.

In an embodiment, the light source is a light emitting diode.

In an embodiment, the light source is located at a side of the light guide plate.

In an embodiment, the light guide plate further includes a slot, wherein the light source is inserted into the slot of the light guide plate.

In an embodiment, the light guide plate is disposed over the wiring plate.

In an embodiment, the light guide plate is disposed under the wiring plate.

In an embodiment, the first circuit layer, the second circuit layer and the light source circuit layer are formed by a printing process, a spraying process or an electroplating process.

In an embodiment, the first circuit layer, the second circuit layer and the light source circuit layer are made of light-transmissible and electrically-conductive material.

In an embodiment, the partition plate includes plural perforations.

In an embodiment, the wiring plate includes a pin, wherein the pin is electrically connected with the second circuit layer and the light source circuit layer.

In an embodiment, the key structure includes a keycap, a key base, and an elastic element. The keycap includes a pressing part and a plunger. The key base is used for placing the plunger of the keycap thereon. The elastic element is disposed under the plunger for contacting with the backlight membrane switch board and allowing the keycap to be returned to an original position.

In an embodiment, the key structure includes a keycap, a scissors-type supporting structure, and an elastic element. The scissors-type supporting structure is connected with the keycap and the backlight membrane switch board. The elastic element is disposed under the keycap for contacting with the backlight membrane switch board and allowing the keycap to be returned to an original position.

In an embodiment, the illuminated keyboard further includes a base plate. The base plate is disposed under the backlight membrane switch board for supporting the backlight membrane switch board.

In an embodiment, the illuminated keyboard further includes a reflective plate. The reflective plate is disposed under the backlight membrane switch board for reflecting the light beam.

In an embodiment, the key structure further includes a light-outputting region for outputting the light beam.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
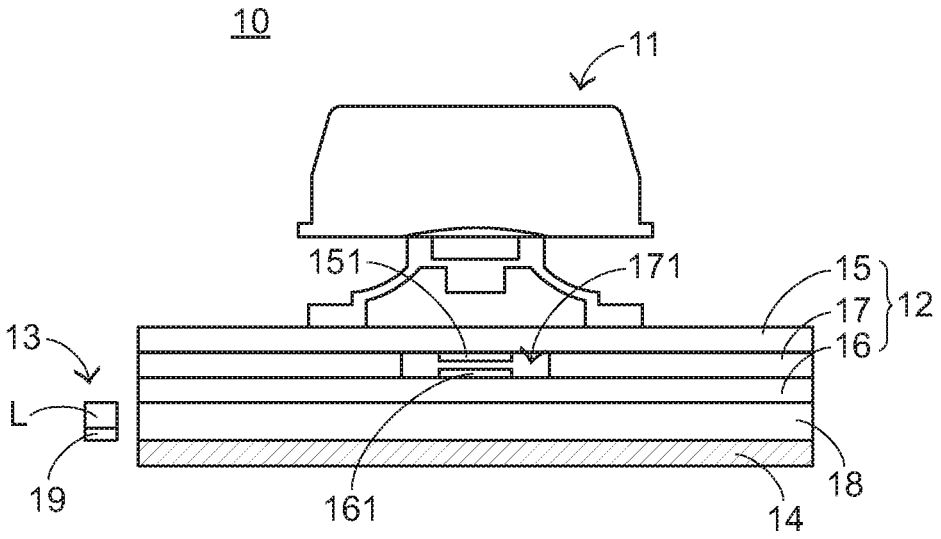
FIG.1 PRIOR ART
FIG. 1 is a schematic cross-sectional view illustrating a conventional illuminated keyboard.
Figure 2:
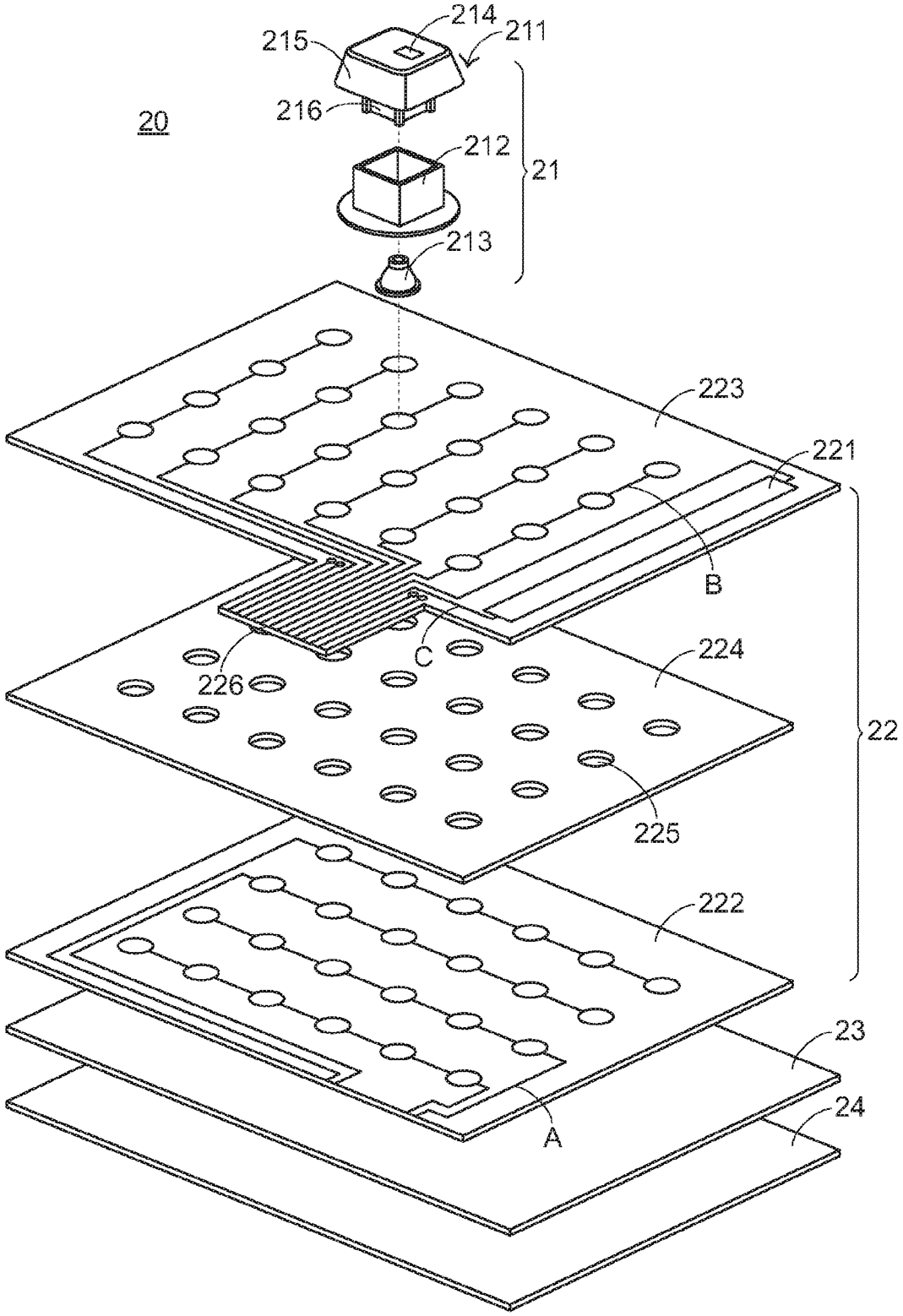
FIG. 2 is a schematic exploded view illustrating an illuminated keyboard according to a first embodiment of the present invention.

FIG. 2 is a schematic exploded view illustrating an illuminated keyboard according to a first embodiment of the present invention. The illuminated keyboard 20 comprises a key structure 21, a backlight membrane switch board 22, a reflective plate 23, and a base plate 24. The key structure 21 may be depressed to trigger a key signal. When the key structure 21 is depressed by the user, the key signal is correspondingly triggered. The backlight membrane switch board 22 is disposed under the key structure 21 for emitting a light beam to the key structure 21.

The reflective plate 23 is disposed under the backlight membrane switch board 22 for reflecting the portion of the light beam that is transmitted from the bottom of the backlight membrane switch board 22. Due to the reflective plate 23, the leakage percentage of the light beam from the backlight membrane switch board 22 will be reduced.

The base plate 24 is disposed under the backlight membrane switch board 22 (especially under the reflective plate 23) for supporting the key structure 21, the backlight membrane switch board 22 and the reflective plate 23. After the key structure 21, the backlight membrane switch board 22 and the reflective plate 23 are fixed on the base plate 24, the illuminated keyboard 20 is fabricated.

The reflective plate 23 is used to recycle the light beam, and the base plate 24 is used to support the key structure 21 and the backlight membrane switch board 22. It is noted that the reflective plate and the base plate are not essential components. In some other embodiments, the reflective plate 23 and the base plate 24 are not included in the illuminated keyboard 20. Alternatively, in some other embodiments, the reflective plate 23 and the base plate 24 are integrally formed as a body plate. Alternatively, in some other embodiments, the surface of the base plate 24 is coated with reflective paint, so that the base plate 24 has the function of reflecting the light beam.

The key structure 21 may be a plunger key structure, a scissors key structure or any other key structure that is known in the art. In this embodiment, the key structure 21 is a plunger key structure. As shown in FIG. 2, the key structure 21 comprises a keycap 211, a key base 212, an elastic element 213 and a light-outputting region 214 The keycap 211 comprises a pressing part 215 and a plunger 216.

The pressing part 215 is disposed on a top surface of the keycap 211 to be depressed by the user. The plunger 216 is connected with the pressing part 215. In addition, the plunger 216 and the pressing part 215 are linked with each other. The plunger 216 is disposed within the key base 212, and the plunger 216 is movable upwardly or downwardly relative to the key base 212. The elastic element 213 is arranged between the plunger 216 and the backlight membrane switch board 22 for providing a restoring force. In response to the restoring force, the keycap 211 is returned to its original position. The light-outputting region 214 is formed on the keycap 211 for outputting the light beam, thereby facilitating the user to identify the key structure 21. Moreover, the light-outputting region 214 is a light-outputting number region, a light-outputting character region or a light-outputting symbol region. The method of forming the light-outputting region 214 is similar to the method of forming the light-outputting region of the conventional illuminated keyboard, and is not redundantly described herein.

As the pressing part 215 of the keycap 211 is depressed by the user, the plunger 216 is linked with the pressing part 215, so that the plunger 216 is moved downwardly relative to the key base 212. In addition, since the elastic element 213 is compressed and subjected to deformation, the elastic element 213 is contacted with the backlight membrane switch board 22.

The backlight membrane switch board 22 comprises a light source 221, a light guide plate 222, a wiring plate 223, and a partition plate 224. The light guide plate 222 comprises a first circuit layer A. The wiring plate 223 comprises a pin 226, a second circuit layer B, and a light source circuit layer C. The partition plate 224 comprises plural perforations 225.

The light source 221 is disposed on the wiring plate 223 for emitting a light beam. The light source 221 may be located at a side of the light guide plate 222 or penetrated through the light guide plate 222. The light guide plate 222 can be disposed over or under the wiring plate 223 for transferring the light beam from the light source 221. In this embodiment, the light source 221 is located at a side of the light guide plate 222, and the light guide plate 222 is disposed under the wiring plate 223.

The first circuit layer A of the light guide plate 222 is disposed on a top surface of the light guide plate 222. The pin 226, the second circuit layer B and the light source circuit layer C of the wiring plate 223 are disposed on a bottom surface of the wiring plate 223. The light source circuit layer C is electrically connected with the light source 221 for driving the light source 221 to emit the light beam. The pin 226 is electrically connected with a power source (not shown) for receiving electric power. In addition, the key signal is outputted from the pin 226. Since the second circuit layer B and the light source circuit layer C are located at the same plane with respect to the wiring plate 223, the light source circuit layer C is electrically connected with the pin 226, and the pin 226 is shared by the light source circuit layer C and the second circuit layer B.

In this embodiment, the light source 221 comprises one or more light emitting diodes, but is not limited thereto. In this embodiment, the first circuit layer A, the second circuit layer B and the light source circuit layer C are light-transmissible and electrically-conductive material. An example of the light-transmissible and electrically-conductive material includes but is not limited to indium tin oxide (ITO), nano silver, nano Cu, carbon nanotube, or graphene. Moreover, the first circuit layer A, the second circuit layer B and the light source circuit layer C are formed by a printing process, a spraying process or an electroplating process, but are not limited thereto.

The partition plate 224 is arranged between the light guide plate 222 and the wiring plate 223 in order to prevent from direct contact between the first circuit layer A of the light guide plate 222 and the second circuit layer B of the wiring plate 223. As the key structure 21 is depressed by the user, the key structure 21 is moved downwardly, and the elastic element 213 of the key structure 21 is subjected to deformation to press the wiring plate 223. Consequently, the second circuit layer B of the wiring plate 223 is penetrated through a corresponding perforation 225 and contacted with the first circuit layer A of the light guide plate 222. Under this circumstance, the electrical connection between the first circuit layer A and the second circuit layer B results in the key signal.

Preferably, the light guide plate 222, the wiring plate 223 and the partition plate 224 are made of light-transmissible material, so that the light beam can be transmitted through the backlight membrane switch board 22. An example of the light-transmissible material includes but is not limited to polymethylmethacrylate (PMMA), polycarbonate (PC) or polyethylene terephthalate (PET).

Hereinafter, an illuminated keyboard according to a second embodiment of the present invention will be illustrated with reference to FIG. 3.

Figure 3:
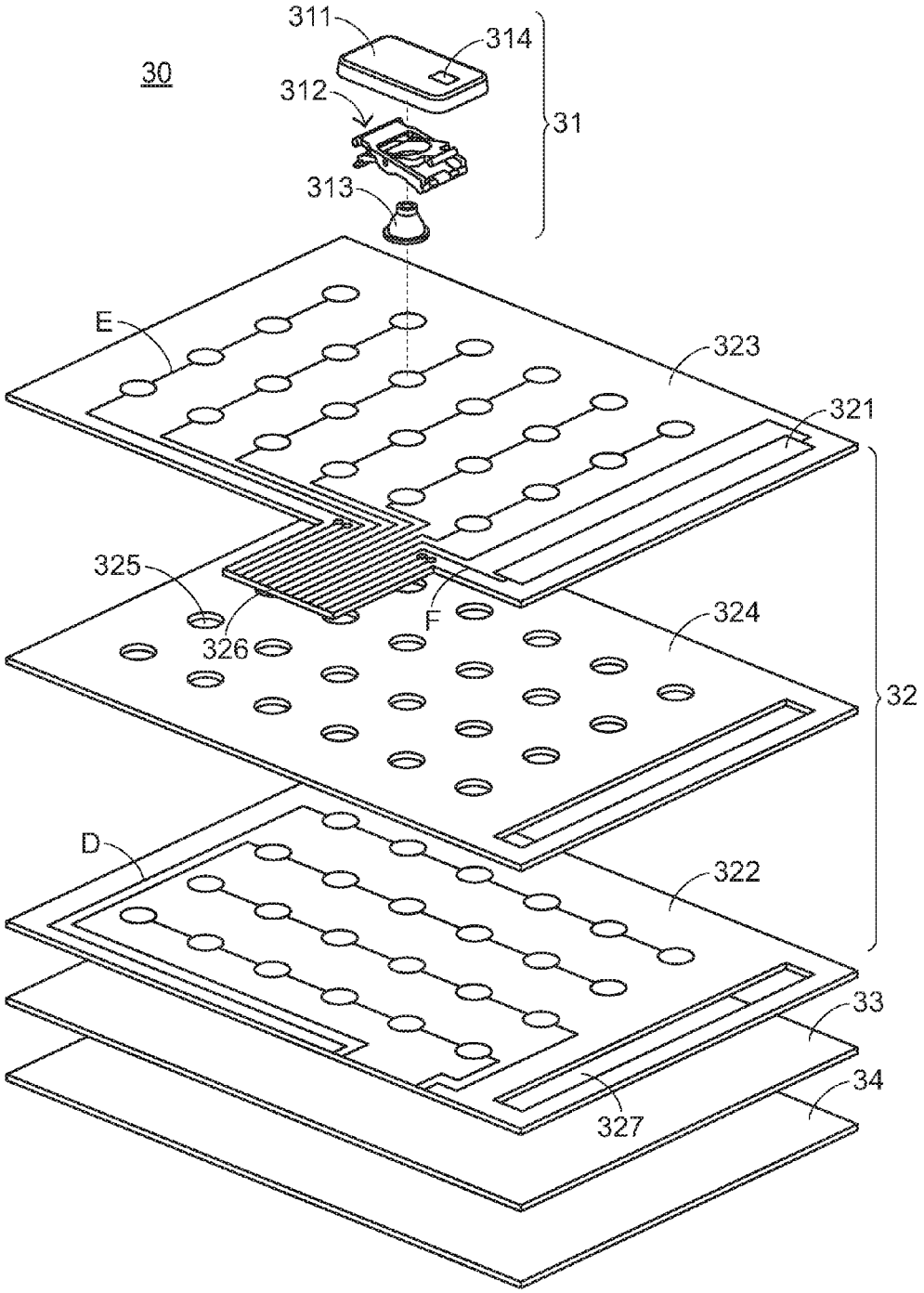
FIG. 3 is a schematic exploded view illustrating an illuminated keyboard according to a second embodiment of the present invention.

FIG. 3 is a schematic exploded view illustrating an illuminated keyboard according to a second embodiment of the present invention. As shown in FIG. 3, the illuminated keyboard 30 comprises a key structure 31, a backlight membrane switch board 32, a reflective plate 33, and a base plate 34. The key structure 31 may be depressed to trigger a key signal. When the key structure 31 is depressed, the key signal is correspondingly triggered. The backlight membrane switch board 32 is disposed under the key structure 31 for emitting a light beam to the key structure 31.

The reflective plate 33 is disposed under the backlight membrane switch board 32 for reflecting the portion of the light beam that is transmitted from the bottom of the backlight membrane switch board 32. Due to the reflective plate 33, the leakage percentage of the light beam from the backlight membrane switch board 32 will be reduced.

The base plate 34 is disposed under the backlight membrane switch board 32 (especially under the reflective plate 33) for supporting the key structure 31, the backlight membrane switch board 32 and the reflective plate 33. After the key structure 31, the backlight membrane switch board 32 and the reflective plate 33 are fixed on the base plate 34, the illuminated keyboard 30 is fabricated.

The reflective plate 33 is used to recycle the light beam, and the base plate 34 is used to support the key structure 31 and the backlight membrane switch board 32. It is noted that the reflective plate and the base plate are not essential components. In some other embodiments, the reflective plate 33 and the base plate 34 are not included in the illuminated keyboard 30. Alternatively, in some other embodiments, the reflective plate 33 and the base plate 34 are integrally formed as a body plate. Alternatively, in some other embodiments, the surface of the base plate 34 is coated with reflective paint, so that the base plate 34 has the function of reflecting the light beam.

The key structure 31 may be a plunger key structure, a scissors key structure or any other key structure that is known in the art. In this embodiment, the key structure 31 is a scissors key structure. The key structure 31 comprises a keycap 311, a scissors-type supporting structure 312, an elastic element 313, and a light-outputting region 314.

The scissors-type supporting structure 312 is arranged between the keycap 311 and the backlight membrane switch board 32. Moreover, the scissors-type supporting structure 312 is connected with the keycap 311 and the backlight membrane switch board 32, so that the keycap 311 is moved upwardly or downwardly relative to the backlight membrane switch board 32. The elastic element 313 is disposed under the keycap 311 for providing a restoring force. In response to the restoring force, the keycap 311 is returned to its original position. The light-outputting region 314 is formed on the keycap 311 for outputting the light beam, thereby facilitating the user to identify the key structure 31. Moreover, the light-outputting region 314 is a light-outputting number region, a light-outputting character region or a light-outputting symbol region. The method of forming the light-outputting region 314 is similar to the method of forming the light-outputting region of the conventional illuminated keyboard, and is not redundantly described herein.

As the keycap 311 is contacted and depressed by the user, the keycap 311 is moved downwardly toward the backlight membrane switch board 32. In addition, since the elastic element 313 is compressed and subjected to deformation, the elastic element 313 is contacted with the backlight membrane switch board 32.

The backlight membrane switch board 32 comprises a light source 321, a light guide plate 322, a wiring plate 323, and a partition plate 324. The light guide plate 322 comprises a first circuit layer D and a slot 327. The wiring plate 323 comprises a pin 326, a second circuit layer E, and a light source circuit layer F. The partition plate 324 comprises plural perforations 325.

The light source 321 is disposed on the wiring plate 323 for emitting a light beam. The light source 321 may be located at a side of the light guide plate 322 or penetrated through the light guide plate 322. The light guide plate 322 can be disposed over or under the wiring plate 323 for transferring the light beam from the light source 321. In this embodiment, the light source 321 is inserted into the slot 327 of the light guide plate 322, and the light guide plate 322 is disposed under the wiring plate 323.

The first circuit layer D of the light guide plate 322 is disposed on a top surface of the light guide plate 322. The pin 326, the second circuit layer E and the light source circuit layer F of the wiring plate 323 are disposed on a bottom surface of the wiring plate 323. The light source circuit layer F is electrically connected with the light source 321 for driving the light source 321 to emit the light beam. The pin 326 is electrically connected with a power source (not shown) for receiving electric power. In addition, the key signal is outputted from the pin 326. Since the second circuit layer E and the light source circuit layer F are located at the same plane with respect to the wiring plate 323, the light source circuit layer F is electrically connected with the pin 326, and the pin 326 is shared by the light source circuit layer F and the second circuit layer E.

In this embodiment, the light source 321 comprises one or more light emitting diodes, but is not limited thereto. In this embodiment, the first circuit layer D, the second circuit layer E and the light source circuit layer F are light-transmissible and electrically-conductive material. An example of the light-transmissible and electrically-conductive material includes but is not limited to indium tin oxide (ITO), nano silver, nano Cu, carbon nanotube, or graphene. Moreover, the first circuit layer D, the second circuit layer E and the light source circuit layer F are formed by a printing process, a spraying process or an electroplating process, but are not limited thereto.

The partition plate 324 is arranged between the light guide plate 322 and the wiring plate 323 in order to prevent form direct contact between the first circuit layer D of the light guide plate 322 and the second circuit layer E of the wiring plate 323. As the key structure 31 is depressed by the user, the key structure 31 is moved downwardly, and the elastic element 313 of the key structure 31 is subjected to deformation to press the wiring plate 323. Consequently, the second circuit layer E of the wiring plate 323 is penetrated through a corresponding perforation 325 of the partition plate 324 and contacted with the first circuit layer D of the light guide plate 322. Under this circumstance, the electrical connection between the first circuit layer D and the second circuit layer E results in the key signal.

Preferably, the light guide plate 322, the wiring plate 323 and the partition plate 324 are made of light-transmissible material, so that the light beam can be transmitted through the backlight membrane switch board 32. An example of the light-transmissible material includes but is not limited to polymethylmethacrylate (PMMA), polycarbonate (PC) or polyethylene terephthalate (PET).

Hereinafter, an illuminated keyboard according to a third embodiment of the present invention will be illustrated with reference to FIG. 4.

Figure 4:
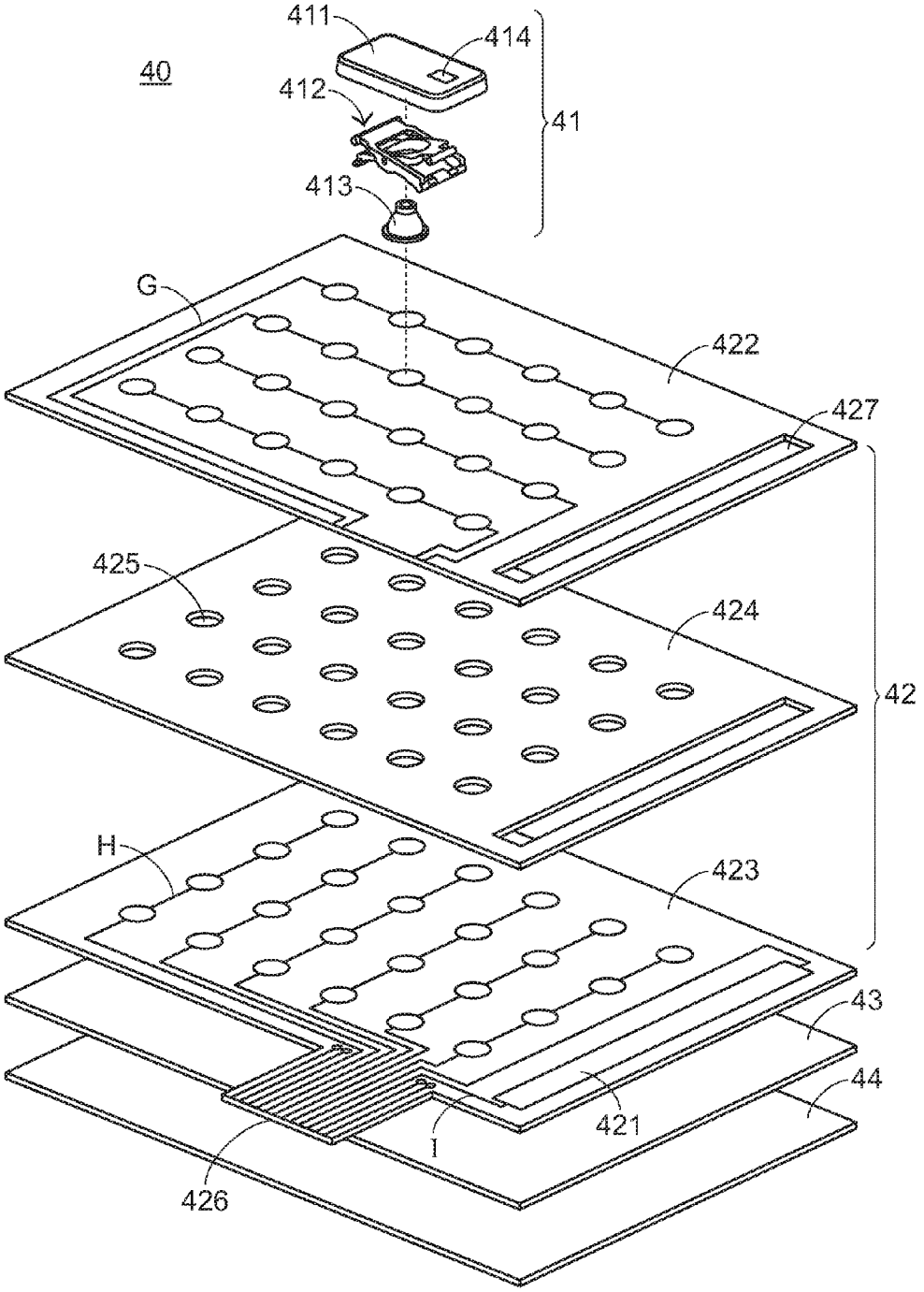
FIG. 4 is a schematic exploded view illustrating an illuminated keyboard according to a third embodiment of the present invention.

FIG. 4 is a schematic exploded view illustrating an illuminated keyboard according to a third embodiment of the present invention. As shown in FIG. 4, the illuminated keyboard 40 comprises a key structure 41, a backlight membrane switch board 42, a reflective plate 43, and a base plate 44. The key structure 41 may be depressed to trigger a key signal. When the key structure 41 is depressed, the key signal is correspondingly triggered. The backlight membrane switch board 42 is disposed under the key structure 41 for emitting a light beam to the key structure 41.

The reflective plate 43 is disposed under the backlight membrane switch board 42 for reflecting the portion of the light beam that is transmitted from the bottom of the backlight membrane switch board 42. Due to the reflective plate 43, the leakage percentage of the light beam from the backlight membrane switch board 42 will be reduced.

The base plate 44 is disposed under the backlight membrane switch board 42 (especially under the reflective plate 43) for supporting the key structure 41, the backlight membrane switch board 42 and the reflective plate 43. After the key structure 41, the backlight membrane switch board 42 and the reflective plate 43 are fixed on the base plate 44, the illuminated keyboard 40 is fabricated.

The reflective plate 43 is used to recycle the light beam, and the base plate 44 is used to support the key structure 41 and the backlight membrane switch board 42. It is noted that the reflective plate and the base plate are not essential components. In some other embodiments, the reflective plate 43 and the base plate 44 are not included in the illuminated keyboard 40. Alternatively, in some other embodiments, the reflective plate 43 and the base plate 44 are integrally formed as a body plate. Alternatively, in some other embodiments, the surface of the base plate 44 is coated with reflective paint, so that the base plate 44 has the function of reflecting the light beam.

The key structure 41 may be a plunger key structure, a scissors key structure or any other key structure that is known in the art. In this embodiment, the key structure 41 is a scissors key structure. The key structure 41 comprises a keycap 411, a scissors-type supporting structure 412, an elastic element 413, and a light-outputting region 414.

The scissors-type supporting structure 412 is arranged between the keycap 411 and the backlight membrane switch board 42. Moreover, the scissors-type supporting structure 412 is connected with the keycap 411 and the backlight membrane switch board 42, so that the keycap 411 is moved upwardly or downwardly relative to the backlight membrane switch board 42. The elastic element 413 is disposed under the keycap 411 for providing a restoring force. In response to the restoring force, the keycap 411 is returned to its original position. The light-outputting region 414 is formed on the keycap 411 for outputting the light beam, thereby facilitating the user to identify the key structure 41. Moreover, the light-outputting region 414 is a light-outputting number region, a light-outputting character region or a light-outputting symbol region. The method of forming the light-outputting region 414 is similar to the method of forming the light-outputting region of the conventional illuminated keyboard, and is not redundantly described herein.

As the keycap 411 is contacted and depressed by the user, the keycap 411 is moved downwardly toward the backlight membrane switch board 42. In addition, since the elastic element 413 is compressed and subjected to deformation, the elastic element 413 is contacted with the backlight membrane switch board 42.

The backlight membrane switch board 42 comprises a light source 421, a light guide plate 422, a wiring plate 423, and a partition plate 424. The light guide plate 422 comprises a first circuit layer G and a slot 427. The wiring plate 423 comprises a pin 426, a second circuit layer H, and a light source circuit layer I. The partition plate 424 comprises plural perforations 425.

The light source 421 is disposed on the wiring plate 423 for emitting a light beam. The light source 421 may be located at a side of the light guide plate 422 or penetrated through the light guide plate 422. The light guide plate 422 can be disposed over or under the wiring plate 423 for transferring the light beam from the light source 421. In this embodiment, the light source 421 is inserted into the slot 427 of the light guide plate 422, and the light guide plate 422 is disposed over the wiring plate 423.

The first circuit layer G of the light guide plate 422 is disposed on a bottom surface of the light guide plate 422. The pin 426, the second circuit layer H and the light source circuit layer I of the wiring plate 423 are disposed on a top surface of the wiring plate 423. The light source circuit layer I is electrically connected with the light source 421 for driving the light source 421 to emit the light beam. The pin 426 is electrically connected with a power source (not shown) for receiving electric power. In addition, the key signal is outputted from the pin 426. Since the second circuit layer H and the light source circuit layer I are located at the same plane with respect to the wiring plate 423, the light source circuit layer I is electrically connected with the pin 426, and the pin 426 is shared by the light source circuit layer I and the second circuit layer H.

In this embodiment, the light source 421 comprises one or more light emitting diodes, but is not limited thereto. In this embodiment, the first circuit layer G, the second circuit layer H and the light source circuit layer I are light-transmissible and electrically-conductive material. An example of the light-transmissible and electrically-conductive material includes but is not limited to indium tin oxide (ITO), nano silver, nano Cu, carbon nanotube, or graphene. Moreover, the first circuit layer G, the second circuit layer H and the light source circuit layer I are formed by a printing process, a spraying process or an electroplating process, but are not limited thereto.

The partition plate 424 is arranged between the light guide plate 422 and the wiring plate 423 in order to prevent from direct contact between the first circuit layer G of the light guide plate 422 and the second circuit layer H of the wiring plate 423. As the key structure 41 is depressed by the user, the key structure 41 is moved downwardly, and the elastic element 413 of the key structure 41 is subjected to deformation to press the light guide plate 422. Consequently, the first circuit layer G of the light guide plate 422 is penetrated through a corresponding perforation 425 of the partition plate 424 and contacted with the second circuit layer H of the wiring plate 423. Under this circumstance, the electrical connection between the first circuit layer G and the second circuit layer H results in the key signal.

Preferably, the light guide plate 422, the wiring plate 423 and the partition plate 424 are made of light-transmissible material, so that the light beam can be transmitted through the backlight membrane switch board 42. An example of the light-transmissible material includes but is not limited to polymethylmethacrylate (PMMA), polycarbonate (PC) or polyethylene terephthalate (PET).

From the above descriptions, the present invention provides an illuminated keyboard. A backlight membrane switch board is used as a light-guiding medium. A light source circuit layer for driving a light source and a second circuit layer for generating a key signal are integrated into a wiring plate of the backlight membrane switch board. Consequently, the backlight membrane switch board has the backlighting function. Since it is not necessary to install an additional light guide plate, the overall height of the illuminated keyboard is reduced. Moreover, since the light source circuit layer and the second circuit layer have a shared pin, the illuminated keyboard can be electrically connected with the external device (e.g. a power source) more easily. Under this circumstance, the ease of assembling the backlight membrane switch board of the present invention is enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An illuminated keyboard, comprising:

a key structure, wherein when said key structure is depressed, a key signal is correspondingly triggered; and a backlight membrane switch board for generating said key signal and emitting a light beam to said key structure, wherein said backlight membrane switch board comprises:

a light source for emitting said light beam;

a light guide plate for transferring said light beam, wherein said light guide plate comprises a first circuit layer;

a wiring plate comprising a second circuit layer and a light source circuit layer, wherein said light source circuit layer is electrically connected with said light source for driving said light source; and a partition plate arranged between said light guide plate and said wiring plate, wherein as said key structure is depressed, said first circuit layer of said light guide plate and said second circuit layer of said wiring plate are contacted with each other to generate said key signal.

2. The illuminated keyboard according to claim 1, wherein said light guide plate, said wiring plate and said partition plate are made of light-transmissible material.

3. The illuminated keyboard according to claim 1, wherein said light source is a light emitting diode.

4. The illuminated keyboard according to claim 1, wherein said light source is located at a side of said light guide plate.

5. The illuminated keyboard according to claim 1, wherein said light guide plate further comprises a slot, wherein said light source is inserted into said slot of said light guide plate.

6. The illuminated keyboard according to claim 1, wherein said light guide plate is disposed over said wiring plate.

7. The illuminated keyboard according to claim 1, wherein said light guide plate is disposed under said wiring plate.

8. The illuminated keyboard according to claim 1, wherein said first circuit layer, said second circuit layer and said light source circuit layer are formed by a printing process, a spraying process or an electroplating process.

9. The illuminated keyboard according to claim 1, wherein said first circuit layer, said second circuit layer and said light source circuit layer are made of light-transmissible and electrically-conductive material.

10. The illuminated keyboard according to claim 1, wherein said partition plate comprises plural perforations.

11. The illuminated keyboard according to claim 1, wherein said wiring plate comprises a pin, wherein said pin is electrically connected with said second circuit layer and said light source circuit layer.

12. The illuminated keyboard according to claim 1, wherein said key structure comprises:

a keycap comprising a pressing part and a plunger;

a key base for placing said plunger of said keycap thereon; and an elastic element disposed under said plunger for contacting with said backlight membrane switch board and allowing said keycap to be returned to an original position.

13. The illuminated keyboard according to claim 1, wherein said key structure comprises:

a keycap;

a scissors-type supporting structure connected with said keycap and said backlight membrane switch board; and an elastic element disposed under said keycap for contacting with said backlight membrane switch board and allowing said keycap to be returned to an original position.

14. The illuminated keyboard according to claim 1, wherein said illuminated keyboard further comprises a base plate, wherein said base plate is disposed under said backlight membrane switch board for supporting said backlight membrane switch board.

15. The illuminated keyboard according to claim 1, wherein said illuminated keyboard further comprises a reflective plate, wherein said reflective plate is disposed under said backlight membrane switch board for reflecting said light beam.

16. The illuminated keyboard according to claim 1, wherein said key structure further comprises a light-outputting region for outputting said light beam.

* * * * *